US007258705B2

(12) United States Patent
Woo et al.

(10) Patent No.: US 7,258,705 B2
(45) Date of Patent: Aug. 21, 2007

(54) ABRASIVE ARTICLE AND METHODS OF MAKING SAME

(75) Inventors: Edward J. Woo, Woodbury, MN (US); Charles R. Wald, Oakdale, MN (US); Curtis J. Schmidt, South St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 11/197,798

(22) Filed: Aug. 5, 2005

(65) Prior Publication Data

US 2007/0028525 A1 Feb. 8, 2007

(51) Int. Cl.

| | |
|---|---|
| ***B24D 3/00*** | (2006.01) |
| ***B24D 11/02*** | (2006.01) |
| ***B24D 18/00*** | (2006.01) |
| ***B24B 11/00*** | (2006.01) |

(52) U.S. Cl. ..... 51/298; 51/307; 51/308; 51/309; 51/293; 451/526; 451/532; 451/538; 451/539; 451/536

(58) Field of Classification Search ..... 51/298, 51/307–309, 293; 451/526, 532, 538, 536, 451/539

See application file for complete search history.

(56) References Cited

U.S. PATENT DOCUMENTS

| | | | |
|---|---|---|---|
| 1,850,413 | A | 3/1932 | Porte |
| 1,862,103 | A | 6/1932 | Stratford |
| 1,961,911 | A | 6/1934 | Pusch |
| 2,123,581 | A | 7/1938 | Anderson |
| 2,740,239 | A | 4/1956 | Ball et al. |
| 2,749,681 | A | 6/1956 | Reidenbach |
| 2,838,890 | A | 6/1958 | McIntyre |
| 2,984,052 | A | 5/1961 | Mueller, Jr. |
| 3,021,649 | A | 2/1962 | Robbins |
| 3,353,308 | A | 11/1967 | Zane |
| 3,420,007 | A | 1/1969 | Kolesh |
| 3,861,892 | A | 1/1975 | Wisdom, Jr. et al. |
| 3,932,966 | A | 1/1976 | Stern |
| 4,001,366 | A | 1/1977 | Brumlik |
| 4,062,152 | A | 12/1977 | Mehrer |
| 4,158,935 | A | 6/1979 | Robert |
| 4,282,011 | A | 8/1981 | Terpay |
| 4,287,685 | A | 9/1981 | Marton |
| 4,437,269 | A | 3/1984 | Shaw |
| 4,590,113 | A | 5/1986 | Herzog |

(Continued)

FOREIGN PATENT DOCUMENTS

| | | |
|---|---|---|
| DE | 34 16 186 A1 | 1/1985 |

(Continued)

OTHER PUBLICATIONS

U.S. Appl. No., 11/321,505, Woo et al., filed Dec. 29, 2005.

(Continued)

*Primary Examiner*—Michael Marcheschi

(57) ABSTRACT

A porous abrasive article that allows air and dust particles to pass through. The abrasive article has a screen abrasive and a polymer netting with hooks. The screen abrasive has an abrasive layer comprising a plurality of abrasive particles and at least one binder. The polymer netting cooperates with the screen abrasive to allow the flow of particles through the abrasive article.

19 Claims, 5 Drawing Sheets

U.S. PATENT DOCUMENTS 4,609,581 A 9/1986 Ott
4,631,220 A 12/1986 Clifton
4,645,699 A 2/1987 Neveu
4,722,203 A 2/1988 Darjee
4,725,487 A 2/1988 Pemrick et al.
4,759,155 A 7/1988 Shaw
4,844,967 A 7/1989 Goralski et al.
4,920,702 A 5/1990 Kloss et al.
4,932,163 A 6/1990 Chilton et al.
4,937,984 A 7/1990 Taranto
4,964,243 A 10/1990 Reiter
4,964,245 A 10/1990 Braasch
5,007,206 A 4/1991 Paterson
5,036,627 A 8/1991 Walters
5,131,924 A 7/1992 Wiand
5,254,194 A 10/1993 Ott et al.
5,256,231 A 10/1993 Gorman et al.
5,317,886 A 6/1994 Prahl
5,354,591 A 10/1994 Ott et al.
5,367,839 A 11/1994 Pearce
5,389,032 A 2/1995 Beardsley
5,458,532 A 10/1995 Cannone
5,490,878 A 2/1996 Peterson et al.
5,505,747 A 4/1996 Chesley et al.
5,533,923 A 7/1996 Shamouilian et al.
5,578,343 A * 11/1996 Gaeta et al. ..... 427/202
5,607,345 A 3/1997 Barry et al.
5,616,394 A 4/1997 Gorman et al.
5,667,540 A 9/1997 Chesley et al.
5,674,122 A * 10/1997 Krech ..... 451/536
5,695,533 A 12/1997 Kardys et al.
5,807,161 A 9/1998 Manor et al.
5,810,650 A 9/1998 Jost
5,891,549 A 4/1999 Beretta et al.
5,904,793 A 5/1999 Gorman et al.
5,954,844 A 9/1999 Law et al.
5,989,112 A 11/1999 Long et al.
6,024,634 A * 2/2000 Hoglund et al. ..... 451/532
6,059,644 A 5/2000 Manor et al.
6,074,292 A 6/2000 Gilday
6,077,156 A 6/2000 Amin et al.
6,077,601 A 6/2000 DeVoe et al.
6,190,246 B1 2/2001 Parrott et al.
6,197,076 B1 3/2001 Braunschweig et al.
6,280,824 B1 8/2001 Insley et al.
6,312,325 B1 11/2001 Van Osenbruggen
6,368,199 B1 4/2002 Van Osenbruggen
6,482,308 B1 11/2002 Wiemann
6,575,821 B2 6/2003 Jöst
6,579,162 B2 6/2003 Chesley et al.
6,613,113 B2 9/2003 Minick et al.
6,790,126 B2 9/2004 Wood et al.
6,923,840 B2 8/2005 Schutz et al.
2003/0003856 A1 1/2003 Swei
2003/0127108 A1 7/2003 Policicchio et al.
2003/0143938 A1 7/2003 Braunschweig et al.
2003/0159363 A1 8/2003 Chesley et al.
2004/0098923 A1 5/2004 Hood et al.
2004/0109978 A1 6/2004 Michel
2004/0148866 A1 8/2004 Krupnick
2004/0166788 A1 8/2004 Travis
2004/0170801 A1* 9/2004 Seth et al. ..... 428/100
2004/0170802 A1* 9/2004 Seth et al. ..... 428/100
2004/0209561 A1 10/2004 Suzuki et al.
2005/0124274 A1 6/2005 Hoglund
2006/0019579 A1 1/2006 Braunschweig

FOREIGN PATENT DOCUMENTS

DE 41 24 520 A1 1/1993
DE 201 11 245 U 1 8/2001
EP 0 064 748 8/1984
EP 0 166 060 9/1988
EP 0 285 042 A1 10/1988
EP 0 578 865 A1 1/1994
EP 0 738 562 10/1996
EP 1 488 888 A1 12/2004
EP 1 524 077 A1 4/2005
EP 1 733 844 A1 12/2006
FR 2 659 892 9/1991
FR 2 739 308 4/1997
GB 1137556 12/1968
GB 1539477 1/1970
GB 2 017 485 A 10/1979
GB 2 057 483 A 4/1981
GB 2 162 213 A 1/1986
GB 2 199 053 A 6/1988
JP 5-220670 8/1993
JP 11-179668 7/1999
WO WO90/14039 11/1990
WO WO96/07509 3/1996
WO WO 00/64634 11/2000
WO WO 03/020474 A1 3/2003

OTHER PUBLICATIONS

U.S. Appl. No. 11/198,265, Woo et al., filed Aug. 5, 2005.
U.S. Appl. No. 11/228,896, Rambosek et al., filed Sep. 16, 2005.
U.S. Appl. No. 11/229,277, Woo et al., filed Sep. 16, 2005.
U.S. Appl. No. 11/229,281, Woo et al., filed Sep. 1, 2005.
U.S. Appl. No. 29/238,541, Braunschweig et al., filed Sep. 16, 2005.
U.S. Appl. No. 29/238,542, Braunschweig et al., filed Sep. 16, 2005.
U.S. Appl. No. 29/238,556, Braunschweig et al., filed Sep. 16, 2005.
U.S. Appl. No. 29/246,256, Shimizu et al., filed Mar. 28, 2006.
U.S. Appl. No. 29/246,257, Shimizu et al., filed Mar. 28, 2006.
U.S. Appl. No. 29/246,258, Shimizu et al., filed Mar. 28, 2006.
U.S. Appl. No. 29/246,259, Shimizu et al., filed Mar. 28, 2006.
U.S. Appl. No. 29/246,260, Shimizu et al., filed Mar. 28, 2006.
U.S. Appl. No. 29/246,261, Shimizu et al., filed Mar. 28, 2006.
U.S. Appl. No. 29/253,148, Braunschweig et al., filed Feb. 1, 2006.
U.S. Appl. No. 29/253,110, Braunschweig et al., filed Feb. 1, 2006.
U.S. Appl. No. 29/253,085, Braunschweig et al., filed Feb. 1, 2006.
U.S. Appl. No. 29/253,084, Braunschweig et al., filed Feb. 1, 2006.
"robAust", Roberlo Abrasives, Copyright © 2002-2006 robAust Pty Ltd., [retrieved from the internet on Jul. 6, 2006], URL <http://www.robaust.com/shopdisplayproducts.asp?id=30&cat=Roberlo+Abrasives>, pp. 2.
"List of Products", Roberlo United States, © Copyright 2003 Roberloroberlousa.com, roberlo.com), [retrieved from the internet on Jan. 7, 2004], URL <http://www.roberlousa.com/abrasives.htm>, pp. 2.

* cited by examiner

ABRASIVE ARTICLE AND METHODS OF MAKING SAME

FIELD OF THE INVENTION

The present invention relates generally to an abrasive article and, more particularly, to a porous abrasive article that allows air and dust particles to pass through.

BACKGROUND

Abrasive articles are used in industry for abrading, grinding, and polishing applications. They can be obtained in a variety of converted forms, such as belts, discs, sheets, and the like, in many different sizes.

Generally, when using abrasives articles in the form of "sheet goods" (i.e., discs and sheets), a back-up pad is used to mount or attach the abrasive article to the abrading tool. One method of attaching abrasive discs and sheets to back-up pads includes a two-part mechanical engagement system, such as, for example, a hook and loop fastener. When the attachment means is a hook and loop system, the abrasive article will have either a loop or the hook component on the backing surface opposite the abrasive coating, and the back-up pad will have the complementary mating component (i.e., a hook or loop).

One type of back-up pad has dust collection holes connected by a series of grooves to help control swarf build-up on the abrading surface of the abrasive article. The dust collection holes are typically connected to a vacuum source. The dust collection grooves and holes provide a passageway for removing particles such as swarf, dust, and debris from the abrading surface. The passageway can also be used to remove abrading fluids, such as water or oil, from the abrading surface.

In some configurations, particles and fluid pass from the abrading surface of the abrasive article to the back-up pad through holes cut in the abrasive article. The dust extraction capabilities of these designs are limited because of the intermittent presence of the holes. In other configurations, the abrasive article is made from a porous knitted cloth with integral loops, such as reported by Hoglund et al. in U.S. Pat. No. 6,024,634.

There is a continuing need for alternative ways to provide a cost effective abrasive article with a mechanical fastening system and dust extraction capabilities. It would be particularly desirable to provide a porous abrasive article in which the abrasive layer could be designed and manufactured independently of the attachment means.

SUMMARY

The present invention relates generally to an abrasive article and, more particularly, to a porous abrasive article that allows air and dust particles to pass through.

In one aspect, the present invention provides an abrasive article with a screen abrasive comprising an open mesh backing having a first major surface that has a perimeter that defines a screen abrasive surface area, a second major surface, a plurality of openings extending from the first major surface to the second major surface, and an abrasive layer secured to at least a portion of the first major surface of the backing. The abrasive layer comprises a plurality of abrasive particles and at least one binder. A polymer netting is associated with the second major surface of the open mesh backing. The polymer netting a comprises a first plurality of strands extending in a first direction and a second plurality of strands extending in a second direction. The first and second plurality of strands are affixed to one another to form a plurality of openings in the polymer netting. The openings in the polymer netting cooperate with the screen abrasive to allow the flow of particles through the abrasive article. A plurality of hooks project from at least a portion of said second plurality of strands. The hooks can be used to engage the abrasive article to a sanding device with corresponding material that allows the hooks to engage.

In some embodiments, the abrasive article allows particles having a size of at least 10 micrometers to pass through the abrasive article.

In another aspect, the present invention provides methods for making abrasive articles having a screen abrasive and a polymer netting that cooperates with the screen abrasive to allow the flow of particles through the abrasive article.

In another aspect, the present invention provides alternative ways to provide a cost effective abrasive article with a mechanical fastening system and dust extraction capabilities. The abrasive article is useful for abrading a variety of surfaces, including, for example, paint, primer, wood, plastic, fiberglass, and metal. In some embodiments, the abrasive layer can be designed and manufactured independently of the polymer netting, allowing the manufacturer to optimize the performance of the screen abrasive substantially independently of the selection of polymer netting, and vice versa.

The above summary of the present invention is not intended to describe each disclosed embodiment or every implementation of the present invention. The Figures and the detailed description that follow more particularly exemplify illustrative embodiments. The recitation of numerical ranges by endpoints includes all numbers subsumed with that range (e.g., 1 to 5 includes 1, 1.5, 2, 2.75, 3, 4, 4.80, and 5).

These figures, which are idealized, are not to scale and are intended to be merely illustrative of the present invention and non-limiting.

DETAILED DESCRIPTION

Figure 1:
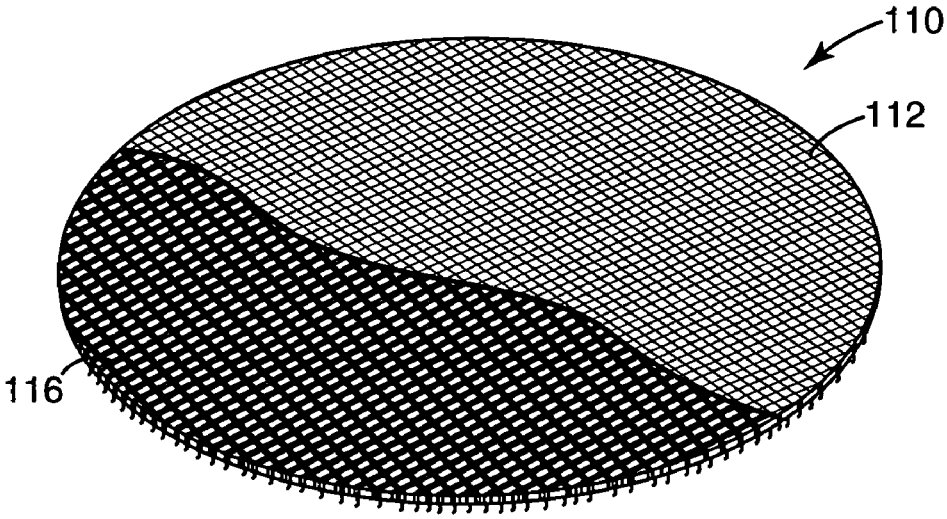
FIG. 1 is a perspective view of an exemplary abrasive article according to the present invention partially cut away to reveal the polymer netting.

FIG. 1 shows a perspective view of an exemplary abrasive article 110 with a partial cut away. As shown in FIG. 1, the abrasive article 110 has a screen abrasive 112 on its upper surface and a polymer netting 116 attached to the screen abrasive 112. The polymer netting 116 cooperates with the screen abrasive 112 to allow the flow of particles through the abrasive article 110.

The polymer netting forms the hook portion of a two-part mechanical engagement system. Abrasive articles according to the present invention may be attached to a variety of surfaces having any suitable engaging structures, such as fibers, filaments (such as brushed nylon and brushed polyester), woven and nonwoven fabrics, knitted fabric, and stitch-bonded fabrics. Other applications are also contemplated, such as attachment to foam (particularly open-cell foam) or to a compatible set of engaging hooks. The polymer netting is typically used to affix the abrasive article of the present invention to a back-up pad. The back-up pad typically includes a generally planar major surface with loops to which the polymer netting of the abrasive article, such as a disc or sheet, may be attached Although back-up pads may be hand held, back-up pads are more commonly used in conjunction with a powered abrading apparatus such as electric or pneumatic sanders. The polymer netting can be designed with hooks that permit the abrasive article to be removed from a back-up pad with a small amount of force. The hooks can also be designed to resist movement of the abrasive article relative to the loop faced back-up pad during use. The desired hook and loop dimensions will depend upon the shape and type of hooks provided and on the desired engagement characteristics of the abrasive article.

Figure 2:
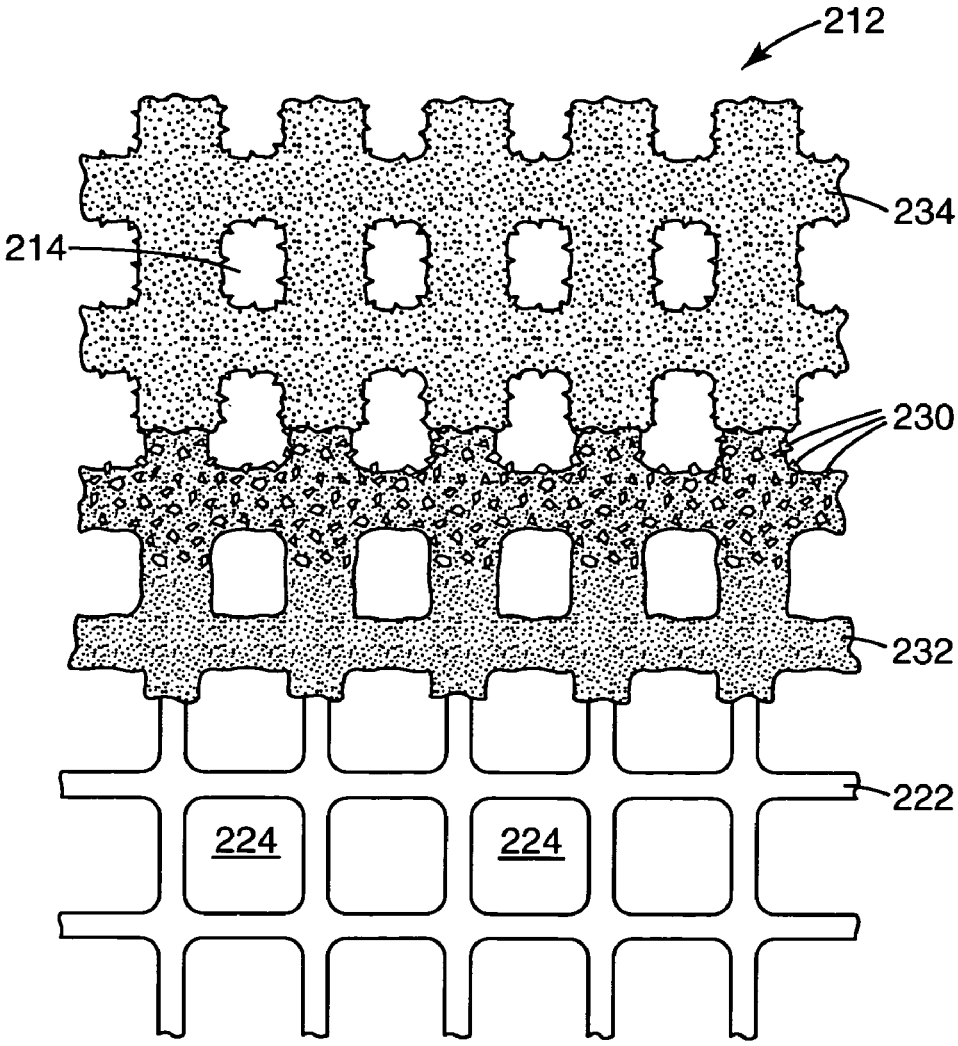
FIG. 2 is a perspective view of an exemplary open mesh screen abrasive partially cut away to reveal the components of the abrasive layer.

FIG. 2 is a perspective view of an exemplary open mesh screen abrasive 212 partially cut away to reveal the components of the abrasive layer. The screen abrasive 212 comprises an open mesh backing 222 covered with an abrasive layer. The open mesh backing 222 has a plurality of openings 224. The abrasive layer comprises a make coat 232, abrasive particles 230, and a size coat 234. A plurality of openings 214 extend through the screen abrasive 212.

The open mesh backing can be made from any porous material, including, for example, perforated films or woven or knitted fabrics. In the embodiment shown in FIG. 2, the open mesh backing 222 is a perforated film. The film for the backing can be made from metal, paper, or plastic, including molded thermoplastic materials and molded thermoset materials. In some embodiments, the open mesh backing is made from perforated or slit and stretched sheet materials. In some embodiments, the open mesh backing is made from fiberglass, nylon, polyester, polypropylene, or aluminum.

The openings 224 in the open mesh backing 222 can be generally square shaped as shown in FIG. 2. In other embodiments, the shape of the openings can be other geometric shapes, including, for example, a rectangle shape, a circle shape, an oval shape, a triangle shape, a parallelogram shape, a polygon shape, or a combination of these shapes. The openings 224 in the open mesh backing 222 can be uniformly sized and positioned as shown in FIG. 2. In other embodiments, the openings may be placed non-uniformly by, for example, using a random opening placement pattern, varying the size or shape of the openings, or any combination of random placement, random shapes, and random sizes.

Figure 3:
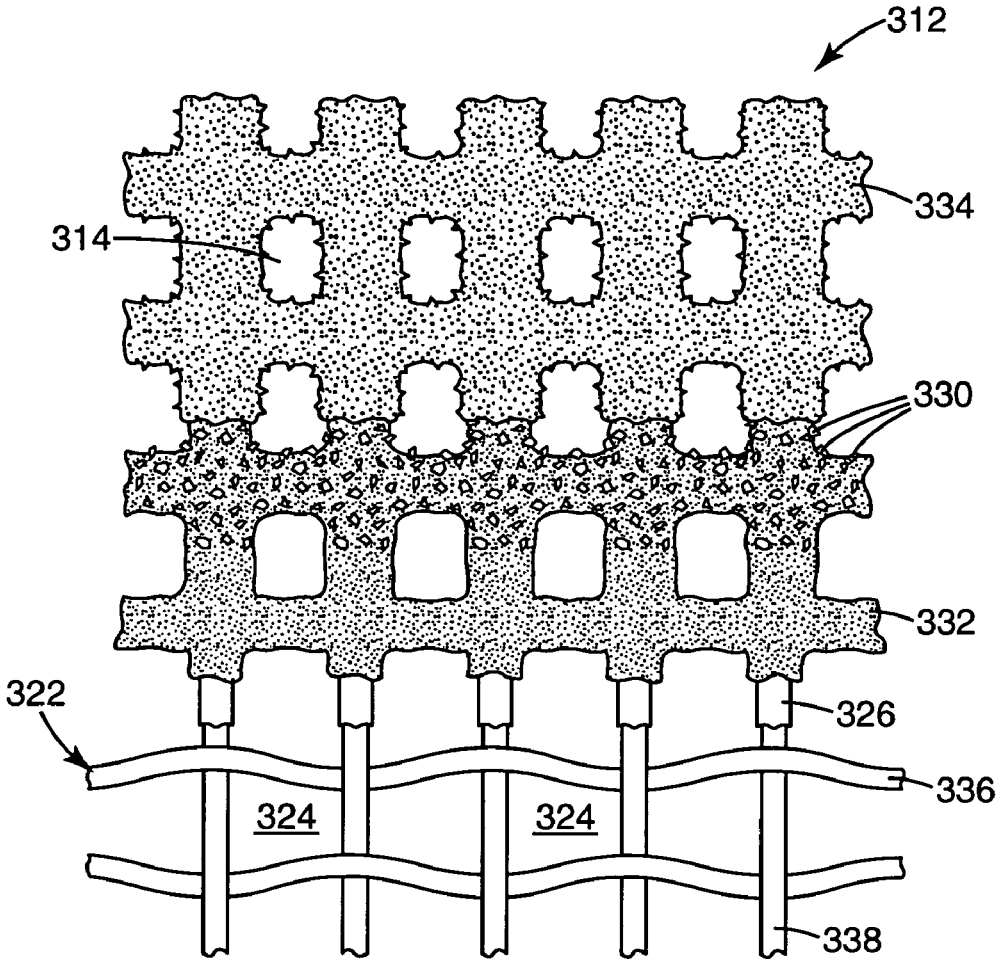
FIG. 3 is a perspective view of an exemplary woven open mesh screen abrasive partially cut away to reveal the components of the abrasive layer.

FIG. 3 is a perspective view of an exemplary woven open mesh screen abrasive partially cut away to reveal the components of the abrasive layer. As shown in FIG. 3, the screen abrasive 312 comprises a woven open mesh backing 322 and an abrasive layer. The abrasive layer comprises a make coat 332, abrasive particles 330, and a size coat 334. A plurality of openings 314 extend through the screen abrasive 312.

The woven open mesh backing 322 comprises a plurality of generally parallel warp elements 338 that extend in a first direction and a plurality of generally parallel weft elements 336 that extend in a second direction. The weft elements 338 and warp elements 336 of the open mesh backing 322 form a plurality of openings 324. An optional lock layer 326 can be used to improve integrity of the open mesh backing or improve adhesion of the abrasive layer to the open mesh backing.

As shown in FIG. 3, the second direction is perpendicular to the first direction to form square shaped openings 324 in the woven open mesh backing 322. In some embodiments, the first and second directions intersect to form a diamond pattern. The shape of the openings can be other geometric shapes, including, for example, a rectangle shape, a circle shape, an oval shape, a triangle shape, a parallelogram shape, a polygon shape, or a combination of these shapes. In some embodiments, the warp and weft elements are yams that are woven together in a one-over-one weave.

The warp and weft elements may be combined in any manner known to those in the art, including, for example, weaving, stitch-bonding, or adhesive bonding. The warp and weft elements may be fibers, filaments, threads, yams or a combination thereof. The warp and weft elements may be made from a variety of materials known to those skilled in the art, including, for example, synthetic fibers, natural fibers, glass fibers, and metal. In some embodiments, the warp and weft elements comprise monofilaments of thermoplastic material or metal wire. In some embodiments, the woven open mesh backing comprises nylon, polyester, or polypropylene.

The openings 324 in the open mesh backing 322 can be uniformly sized and positioned as shown in FIG. 3. In other embodiments, the openings can be placed non-uniformly by, by, for example, using a random opening placement pattern, varying the size or shape of the openings, or any combination of random placement, random shapes, and random sizes.

The open mesh backing, whether woven or perforated, may comprise openings having different open areas. The "open area" of an opening in the mesh backing refers to the area of the opening as measured over the thickness of the mesh backing (i.e., the area bounded by the perimeter of material forming the opening through which a three-dimensional object could pass). Open mesh backings useful in the present invention typically have an average open area of at least about 0.3 square millimeters per opening. In some embodiments, the open mesh backing has an average open area of at least about 0.5 square millimeters per opening. In yet further embodiments, the open mesh backing has an average open area of at least about 0.7 square millimeters per opening.

Typically, open mesh backings useful in the present invention have an average open area that is less than about 3.5 square millimeters per opening. In some embodiments, the open mesh backing has an average open area that is less than about 2.5 square millimeters per opening. In yet further embodiments, the open mesh backing has an average open area that is less than about 0.9 square millimeters per opening.

The open mesh backing, whether woven or perforated, comprises a total open area that affects the amount of air that can pass through the open mesh backing as well as the effective area and performance of the abrasive layer. The "total open area" of the mesh backing refers to the cumulative open areas of the openings as measured over a unit area of the mesh backing. Open mesh backings useful in the present invention have a total open area of at least about 0.5 square centimeters per square centimeter of backing (i.e., 50 percent open area). In some embodiments, the open mesh backing has a total open area of at least about 0.6 square centimeters per square centimeter of backing (i.e., 60 percent open area). In yet further embodiments, the open mesh backing has a total open area of at least about 0.75 square centimeters per square centimeter of backing (i.e., 75 percent open area).

Typically, open mesh backings useful in the present invention have a total open area that is less than about 0.95 square centimeters per square centimeter of backing (i.e., 95 percent open area). In some embodiments, the open mesh backing has a total open area that is less than about 0.9 square centimeters per square centimeter of backing (i.e., 90 percent open area). In yet further embodiments, the open mesh backing has a total open area that is less than about 0.82 square centimeters per square centimeter of backing (i.e., 82 percent open area).

Figure 4:
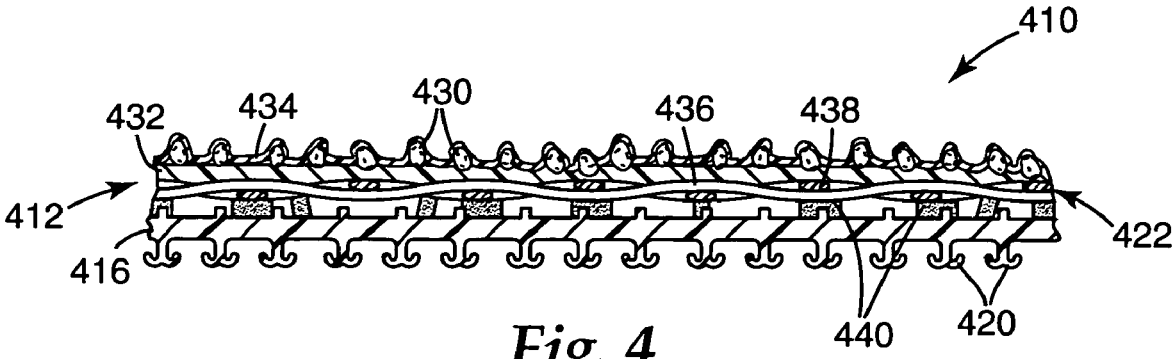
FIG. 4 is a cross-sectional view of an exemplary abrasive article according to the present invention.

FIG. 4 is a cross-sectional view of an exemplary abrasive article 410 according to the present invention. As shown in FIG. 4, the abrasive article 410 comprises a screen abrasive 412 affixed to a polymer netting 416 using adhesive 440. The polymer netting 416 comprises a plurality of hooks 420.

As shown in FIG. 4, the screen abrasive 412 comprises a woven open mesh backing 422 and an abrasive layer. The abrasive layer comprises a make coat 432, abrasive particles 430, and a size coat 434. The screen abrasive 412 comprises a plurality of generally parallel warp elements 438 that extend in a first direction and a plurality of generally parallel weft elements 436 that extend in a second direction. The weft 438 and warp elements 436 of the open mesh backing 422 form a plurality of openings.

Figure 7:
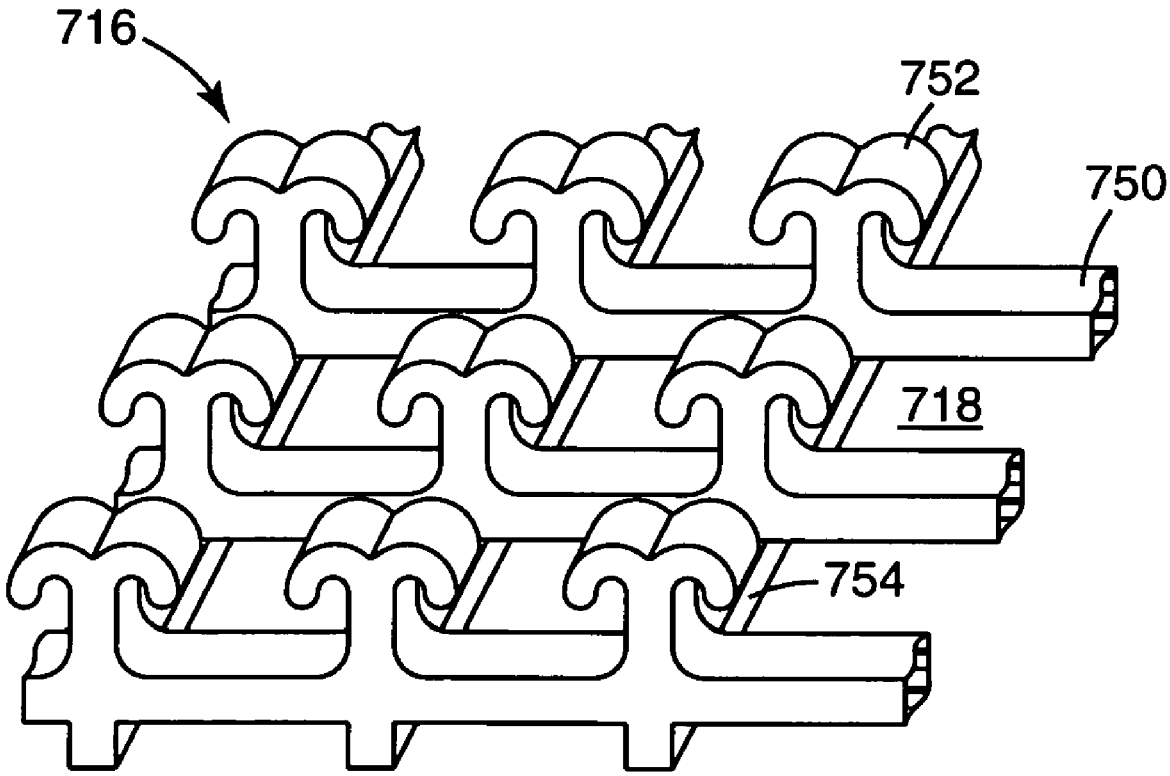
FIG. 7 is a bottom view of exemplary polymer netting according to the present invention.

FIG. 7 shows an exemplary polymer netting 716 useful for the present invention. Other forms of polymer netting useful in the present invention and methods for making polymer netting are reported in U.S. Publication 2004/0170801 (Seth et al.), which is incorporated herein by reference.

As shown in FIG. 7, the polymer netting 716 comprises a first plurality of strands 754 extending in a first direction and a second plurality of strands 750 extending in a second direction. The first plurality of strands 754 and second plurality of strands 750 are affixed to one another to form a lattice. The first and second strands of the polymer netting can be integrally formed as reported in U.S. Publication 2004/0170801 (Seth et al.), which is incorporated herein by reference.

A plurality of openings 718 is formed by the intersecting first strands 754 and second strands 750. As shown in FIG. 7, the openings 718 can be formed from first and second strands that are substantially perpendicular to one another. In other embodiments, the openings can be formed from first and second strands that are acute to one another. In some embodiments, the openings are rectilinear.

Other shapes and geometries of openings in the polymer netting can also be used, including, for example, squares, diamonds, and polygons. The openings can be of a uniform shape and size or vary in size or shape. In some embodiments, the vacuum port configuration of the back-up pad is considered when selecting the shape, size, and placement of the openings in the polymer netting.

The shape and size of the strands of the first and second plurality of strands can be varied. In some embodiments, the shape and size of each of the first and second plurality of strands is configured to provide adequate strength and support for the hooks. The shape and size of each of the first and second plurality of strands can also be configured to accommodate the manufacturing process, including, for example the cutting and stretch process reported in U.S. Publication 2004/0170801 (Seth et al.), incorporated herein by reference.

In some embodiments, the shape and size of the first plurality of strands is configured to provide adequate surface area for affixing the polymer netting to the screen abrasive. In some embodiment, the first plurality of strands is "T"-shaped or "I"-shaped, wherein the upper horizontal portion of the "T" or "I" forms a surface for affixing to the screen abrasive and the opposite end of the "T" or "I" connects with the second plurality of strands. The shape and size of the strands of the first plurality of strands can also be configured to accommodate varying stretch ratios as reported in U.S. Publication 2004/0170801 (Seth et al.).

Typically, openings of the polymer netting useful in the present invention have an average open area no greater than 0.6 square millimeters per opening of the polymer netting. In some embodiments, the average open area is no greater than 0.5 square millimeters per opening of the polymer netting. In yet further embodiments, the average open area is no greater than 0.4 square millimeters per opening of the polymer netting.

Typically, openings of the polymer netting useful in the present invention have an average open area of at least 0.1 square millimeters per opening of the polymer netting. In some embodiments, the average open area is at least 0.2 square millimeters per opening of the polymer netting. In yet further embodiments, the average open area is at least 0.3 square millimeters per opening of the polymer netting.

The polymer netting comprises a cumulative open area that affects the amount of air and particles that can pass through the polymer netting as well as the effective support area for the screen abrasive and, therefore, the performance of the abrasive layer. The "cumulative open area" of the polymer netting refers to the sum of the open areas of the openings as measured over the screen abrasive surface area. The term "screen abrasive surface area" refers to the total area formed by the perimeter of the screen abrasive without consideration of any open areas in the screen. For example, an abrasive article comprising a screen abrasive with a 10 centimeter outer diameter having a polymer netting with 1,600 openings, each having an open area of 0.4 square millimeters, would have a cumulative open area of about 0.8 square centimeters per square centimeter of screen abrasive (i.e., 80 percent cumulative open area).

Polymer nettings useful in the present invention typically have a cumulative open area in the range of 0.65 to 0.95 square centimeters per square centimeter of screen abrasive (i.e., 65 to 95 percent cumulative open area). In some embodiments, the polymer netting has a cumulative open area in the range of 0.7 to 0.9 square centimeters per square centimeter of screen abrasive (i.e., 70 to 90 percent cumulative open area). In yet further embodiments, the polymer netting has a cumulative open area of about 0.8 square centimeters per square centimeter of screen abrasive (i.e., 70 to 90 percent cumulative open area).

Porosity for the abrasive article of the present invention can be measured with a Gurley Densitometer Model 4410. The Gurley Densitometer measures the amount of time, in seconds, required for 300 cubic centimeters of air to pass through a 0.65 square centimeter area of the abrasive article using a 1.39 Joules per meter force. The Gurley apparatus and procedures for its use are known in the textile industry. For purposes of the present invention, an abrasive article shall be considered "porous" if it has a Gurley porosity that is less than 5 seconds per 300 cubic centimeters of air for at least one 0.65 square centimeter area of the abrasive article.

In some embodiments, the abrasive article of the present invention has a Gurley porosity that is no greater than 5 seconds per 300 cubic centimeters of air. In other embodiments, the abrasive article of the present invention has a Gurley porosity that is no greater than 1.5 seconds per 300 cubic centimeters of air. In yet further embodiments, the abrasive article has a Gurley porosity that is no greater than 1 second per 300 cubic centimeters of air.

The polymer netting 716 comprises a plurality of hooks 752 projecting from the second plurality of strands 750. As used herein, the term "hook" refers to a structure that enables the polymer netting to releasably engage structures provided on an opposed surface. Hooks typically comprise a stem with a distal end that extends from the base sheet and a head proximate the distal end of the stem. The design of the hook may be selected from among numerous different designs known to those skilled in the art, including, for example, those reported in U.S. Pat. No. 6,579,161 (Chesley et al.), U.S. Pat. No. 6,843,944 (Bay et al.), and U.S. Publication 2004/0170801 (Seth et al.), which are incorporated herein by reference. It is understood that other hook designs are comprehended by the present invention, though they are not specifically described below.

The shapes, diameters, and lengths of the plurality of hooks can be mixed within a given abrasive article, such that the abrasive article comprises hooks of more than one shape, diameter, and/or length. The shape, size, and orientation of the hooks may be selected to provide suitable shear strength and peel strength for a given application.

The hooks may be straight, arcuate, or otherwise, and may be arranged in a regular array across the polymer netting. The density of hooks can be selected as desired. In some embodiments, the density of hooks is between approximately 8 and 310 hooks per square centimeter, although other hook densities can be provided.

When the abrasive article is attached to an opposed surface, such as a surface having a plurality of loop members, not all of the hooks must engage with the structures (such as a loop) of the opposed surface. Typically, a majority of the hooks will hook the structures of the engaging surface, and the disengagement force will typically be directly related to the number of hooks that are engaged. The percentage of hooks that are engaged by a particular opposed surface depends on many factors, such as hook dimensions and density, and the topography of the opposed surface.

The polymer netting material can be an organic polymeric material, such as a thermoplastic material. Useful materials include, but are not limited to, polyurethanes, polyamides, polyolefins (for example, polyethylene and polypropylene), polyesters, and combinations thereof. The hooks may also comprise one or more additives, including but not limited to fillers, fibers, antistatic agents, lubricants, wetting agents, surfactants, pigments, dyes, coupling agents, plasticizers, and suspending agents.

The screen abrasive 412 may be adhered to the polymer netting 416 using any suitable form of attachment, such as, for example, glue, pressure sensitive adhesive, hot-melt adhesive, spray adhesive, thermal bonding, and ultrasonic bonding.

The screen abrasive is affixed to the polymer netting in a manner that does not prevent the flow of particles through the abrasive article. In some embodiments, the screen abrasive is adhered to the polymer netting in a manner that does not substantially inhibit the flow of particles through the abrasive article. The level of particle flow through the abrasive article can be restricted, at least in part, by the introduction of an adhesive between the screen abrasive and the polymer netting. The level of restriction can be minimized by applying the adhesive to the screen abrasive in a discontinuous fashion such as, for example, as discrete adhesive areas (e.g., atomized spray or starved extrusion die) or distinct adhesive lines (e.g., hot melt swirl-spray or patterned roll coater).

In some embodiments, the particles of swarf, dust, or debris that can flow through the abrasive article of the present invention have a particle size of at least 10 micrometers. In some embodiments, at least 30 micrometer particles can pass through the abrasive article. In yet further embodiments, at least 45 micrometer particles can pass through the abrasive article.

In some embodiments, the screen abrasive is adhered to the polymer netting by applying a spray adhesive, such as, for example, "3M BRAND SUPER 77 ADHESIVE", available from 3M Company, St. Paul, Minn., to one side of the screen abrasive. In other embodiments, a hot-melt adhesive is applied to one side of the screen abrasive using either a hot-melt spray gun or an extruder with a comb-type shim. In yet further embodiments, a preformed adhesive porous mesh is placed between the screen abrasive and the polymer netting.

Adhesives useful in the present invention include both pressure sensitive and non-pressure sensitive adhesives. Pressure sensitive adhesives are normally tacky at room temperature and can be adhered to a surface by application of, at most, light finger pressure, while non-pressure sensitive adhesives include solvent, heat, or radiation activated adhesive systems. Examples of adhesives useful in the present invention include those based on general compositions of polyacrylate; polyvinyl ether; diene-containing rubbers such as natural rubber, polyisoprene, and polyisobutylene; polychloroprene; butyl rubber; butadiene-acrylonitrile polymers; thermoplastic elastomers; block copolymers such as styrene-isoprene and styrene-isoprene-styrene block copolymers, ethylene-propylene-diene polymers, and styrene-butadiene polymers; polyalphaolefins; amorphous polyolefins; silicone; ethylene-containing copolymers such as ethylene vinyl acetate, ethylacrylate, and ethylmethacrylate; polyurethanes; polyamides; polyesters; epoxies; polyvinylpyrrolidone and vinylpyrrolidone copolymers; and mixtures of the above. Additionally, the adhesives can contain additives such as tackifiers, plasticizers, fillers, antioxidants, stabilizers, pigments, diffusing particles, curatives, and solvents.

As discussed above, the abrasive layer of the screen abrasive comprises a plurality of abrasive particles and at least one binder. In some embodiments, the abrasive layer comprises a make coat, a size coat, a supersize coat, or a combination thereof. In some embodiments, a treatment can be applied to the open mesh backing such as, for example, a presize, a backsize, a subsize, or a saturant.

Typically, the make layer of a coated abrasive is prepared by coating at least a portion of the open mesh backing (treated or untreated) with a make layer precursor. Abrasive particles are then at least partially embedded (e.g., by electrostatic coating) to the make layer precursor comprising a first binder precursor, and the make layer precursor is at least partially cured. Electrostatic coating of the abrasive particles typically provides erectly oriented abrasive particles. In the context of the present invention, the term "erectly oriented" refers to a characteristic in which the longer dimensions of a majority of the abrasive particles are oriented substantially perpendicular (i.e., between 60 and 120 degrees) to the backing. Other techniques for erectly orienting abrasive particles can also be used.

Figure 5:
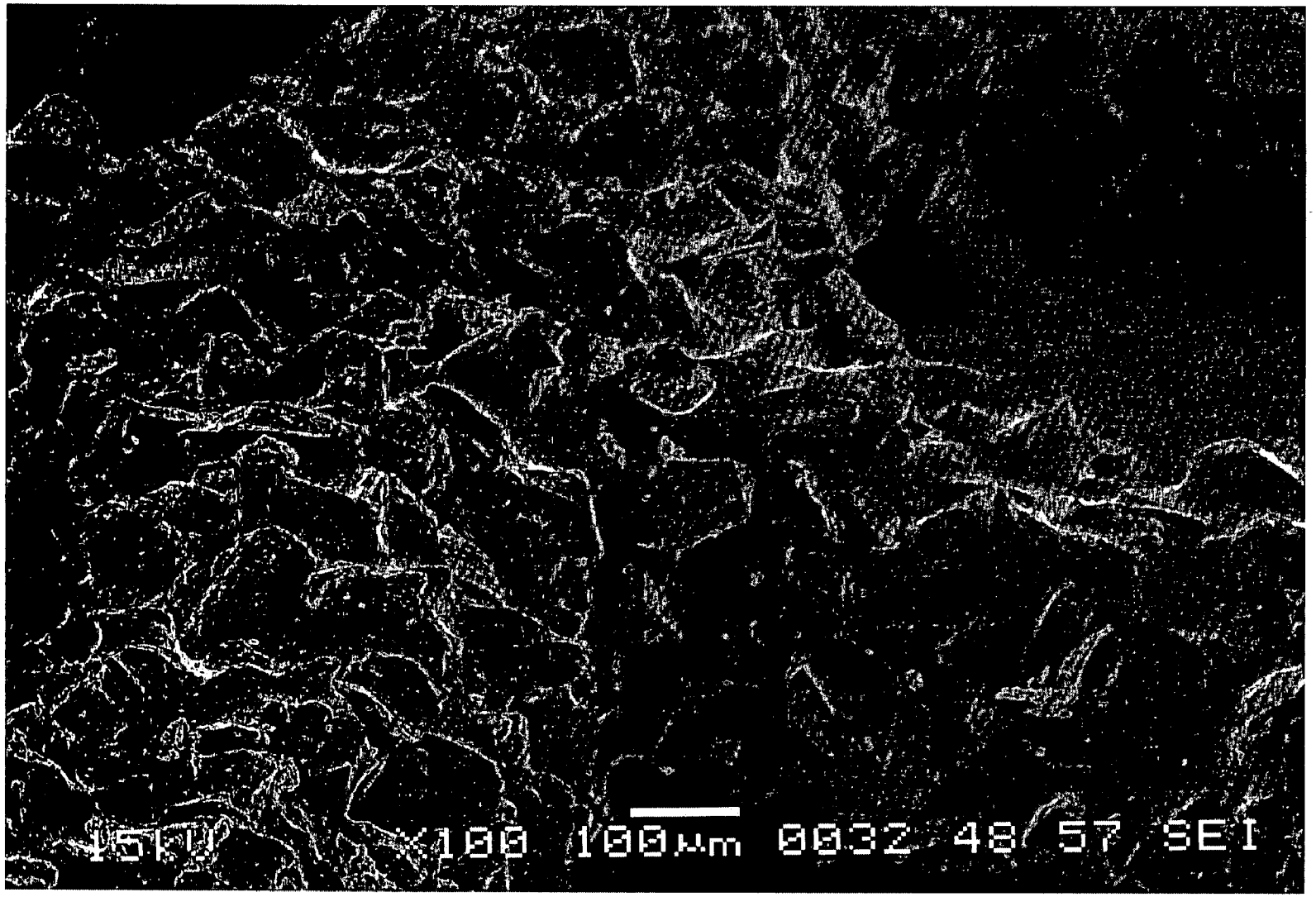
FIG. 5 is a SEM photomicrograph at 100 times of an abrasive surface of a screen abrasive article with abrasive particles that are not erectly oriented.
Figure 6:
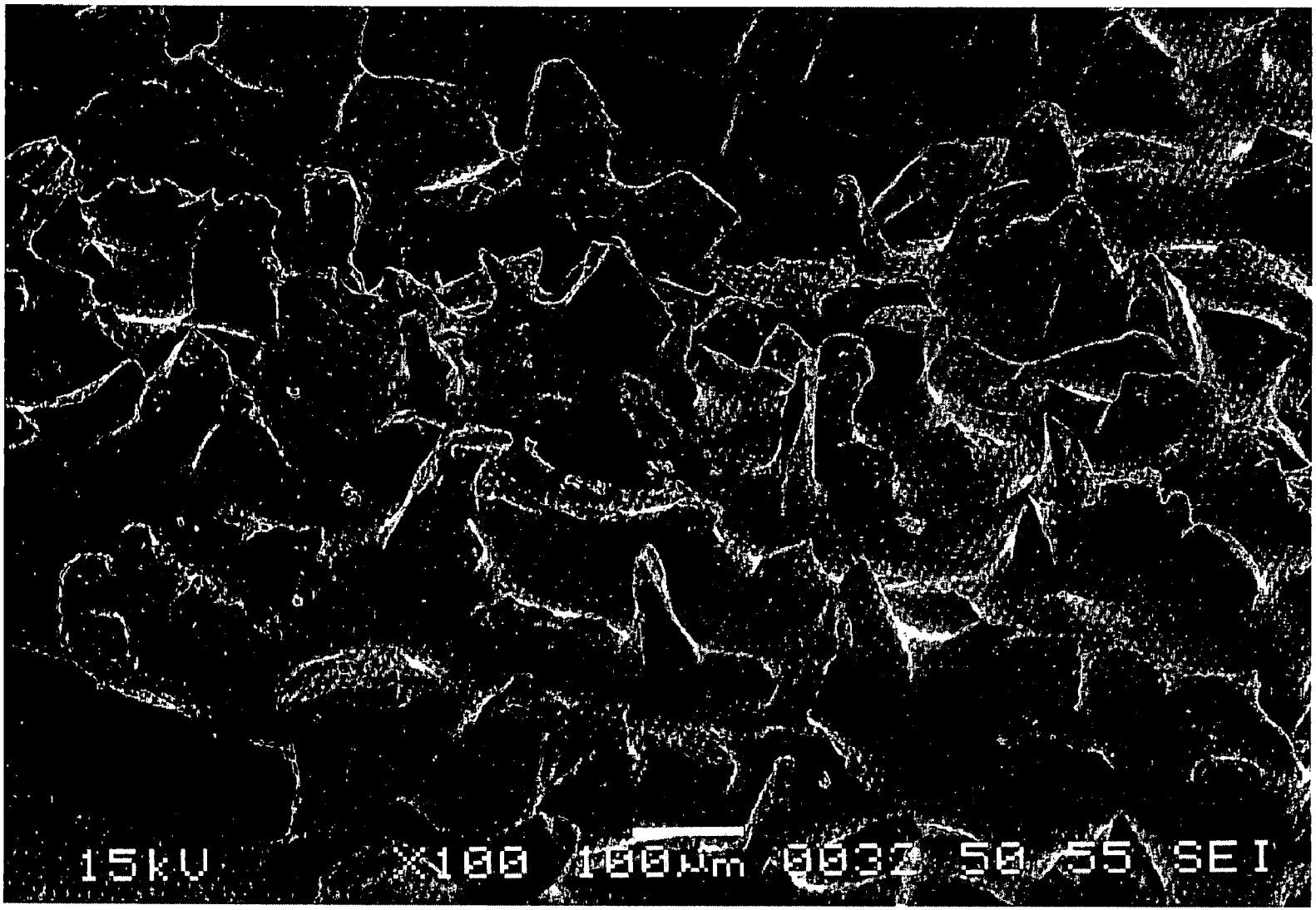
FIG. 6 is a SEM photomicrograph at 100 times of an abrasive surface of a screen abrasive of the present invention having erectly oriented abrasive particles.

FIG. 6 is a SEM photomicrograph at 100 times of an abrasive surface of a screen abrasive of the present invention having erectly oriented abrasive particles. FIG. 5 is a SEM photomicrograph at 100 times of an abrasive surface of a screen abrasive article with abrasive particles that are not erectly oriented.

Next, the size layer is prepared by coating at least a portion of the make layer and abrasive particles with a size layer precursor comprising a second binder precursor (which may be the same as, or different from, the first binder precursor), and at least partially curing the size layer precursor. In some coated abrasive articles, a supersize is applied to at least a portion of the size layer. If present, the supersize layer typically includes grinding aids and/or anti-loading materials.

Typically, a binder is formed by curing (e.g., by thermal means, or by using electromagnetic or particulate radiation) a binder precursor. Useful first and second binder precursors are known in the abrasive art and include, for example, free-radically polymerizable monomer and/or oligomer, epoxy resins, acrylic resins, urethane resings, phenolic resins, urea-formaldehyde resins, melamine-formaldehyde resins, aminoplast resins, cyanate resins, or combinations thereof. Useful binder precursors include thermally curable resins and radiation curable resins, which may be cured, for example, thermally and/or by exposure to radiation.

Suitable abrasive particles for the screen abrasive that can be used in the abrasive article of the present invention can be any known abrasive particles or materials commonly used in abrasive articles. Examples of useful abrasive particles for coated abrasives include, for example, fused aluminum oxide, heat treated aluminum oxide, white fused aluminum oxide, black silicon carbide, green silicon carbide, titanium diboride, boron carbide, tungsten carbide, titanium carbide, diamond, cubic boron nitride, garnet, fused alumina zirconia, sol gel abrasive particles, silica, iron oxide, chromia, ceria, zirconia, titania, silicates, metal carbonates (such as calcium carbonate (e.g., chalk, calcite, marl, travertine, marble and limestone), calcium magnesium carbonate, sodium carbonate, magnesium carbonate), silica (e.g., quartz, glass beads, glass bubbles and glass fibers) silicates (e.g., talc, clays, (montmorillonite) feldspar, mica, calcium silicate, calcium metasilicate, sodium aluminosilicate, sodium silicate) metal sulfates (e.g., calcium sulfate, barium sulfate, sodium sulfate, aluminum sodium sulfate, aluminum sulfate), gypsum, aluminum trihydrate, graphite, metal oxides (e.g., tin oxide, calcium oxide), aluminum oxide, titanium dioxide) and metal sulfites (e.g., calcium sulfite), metal particles (e.g., tin, lead, copper), plastic abrasive particles formed from a thermoplastic material (e.g., polycarbonate, polyetherimide, polyester, polyethylene, polysulfone, polystyrene, acrylonitrile-butadiene-styrene block copolymer, polypropylene, acetal polymers, polyvinyl chloride, polyurethanes, nylon), plastic abrasive particles formed from crosslinked polymers (e.g., phenolic resins, aminoplast resins, urethane resins, epoxy resins, melamine-formaldehyde, acrylate resins, acrylated isocyanurate resins, urea-formaldehyde resins, isocyanurate resins, acrylated urethane resins, acrylated epoxy resins), and combinations thereof. The abrasive particles may also be agglomerates or composites that include additional components, such as, for example, a binder. Criteria used in selecting abrasive particles used for a particular abrading application typically include: abrading life, rate of cut, substrate surface finish, grinding efficiency, and product cost.

Coated screen abrasives can further comprise optional additives, such as, abrasive particle surface modification additives, coupling agents, plasticizers, fillers, expanding agents, fibers, antistatic agents, initiators, suspending agents, photosensitizers, lubricants, wetting agents, surfactants, pigments, dyes, UV stabilizers, and suspending agents. The amounts of these materials are selected to provide the properties desired. Additives may also be incorporated into the binder, applied as a separate coating, held within the pores of the agglomerate, or combinations of the above.

Coated screen abrasive articles may be converted, for example, into belts, rolls, discs (including perforated discs), and/or sheets. One form of a coated screen abrasive useful in finishing operations is a disc. Abrasive discs are often used for the maintenance and repair of automotive bodies and wood finishing. The discs can be configured for use with a variety of tools, including, for example, electric or air grinders. The tool used to support the disc can have a self-contained vacuum system or can be connected to a vacuum line to help contain dust.

Advantages and other embodiments of this invention are further illustrated by the following examples, but the particular materials and amounts thereof recited in these examples, as well as other conditions and details, should not be construed to unduly limit this invention. For example, the basis weight, thickness, and composition of the polymer netting can vary. All parts and percentages are by weight unless otherwise indicated.

Unless otherwise noted, all parts, percentages, and ratios reported in the following examples are on a weight basis, and all reagents used in the examples were obtained, or are available, from general chemical suppliers such as the Sigma-Aldrich Chemical Company, Saint Louis, Mo., or may be synthesized by conventional techniques.

EXAMPLES

Sanding Test #1.

Using a razor blade, interconnecting U-shaped channels, 0.95 centimeter wide by 0.64 centimeter deep, were carved between the five holes of a 12.7 centimeter diameter by 1.6 centimeter thick foam back up pad, available under the trade designation "3M HOOKIT II BACKUP PAD, PART NUMBER 05345" from 3M Company, St. Paul, Minn. A 12.7 centimeter sample disc was attached to the back up pad and then the pad mounted onto a fine finishing dual-action orbital sander, model "21034" from Dynabrade Corporation, Clarence, N.Y. A central dust extraction vacuum line was then attached to the sander. The abrasive layer was manually brought into contact with a pre-weighed 38.1 centimeter by 53.3 centimeter acrylic test panel, obtained from Seelye Eiler Plastics Inc., Bloomington, Minn. The sander was run at 88.5 pounds per square inch (610.2 kilopascals) air line pressure and a down force of 12 pounds (5.4 kilograms) for 45 seconds. An angle of zero degrees to the surface of the workpiece was used. The 45 second abrading cycle is repeated another 4 times, for a total of 3 minutes and 45 seconds. After the final sanding cycle the test panel was re-weighed and the sanding procedure repeated two more times, from which the average cut was determined. A visual observation of swarf on the screen abrasive was also made at the completion of the sanding test.

Sanding Test #2

A 12.7 centimeter sample disc was attached to a 12.7 centimeter by 1.6 centimeter thick foam back up pad, available under the trade designation "3M HOOKIT II BACKUP PAD, PART NUMBER 05245" from 3M Company. The back up pad was then mounted onto the model 21034 sander and, with the central dust extraction vacuum line disconnected, the sanding protocol as described in sanding test #1 was replicated.

A screen abrasive was prepared as follows. A phenolic resin, available under the trade designation "BAKELITE PHENOLIC RESIN" from Bakelite Epoxy Polymer Corporation, Augusta, Ga., was dispersed to 56 percent solids in a 90:10 by weight water:polysolve medium, then diluted to 35 percent by weight solids with ethanol. The resin dispersion was applied as a make coat to a fiberglass plain weave scrim, available under the trade designation "1620-12" from Hexcel Reinforcements, Anderson, S.C. Grade P320 alumina abrasive mineral, obtained under the trade designation "FSX" from Triebacher Schleifmittel AG, Villach, Austria was electrostatically coated onto the resin, cured for 2 hours at 205 degrees Fahrenheit (96 degrees Celsius). A size coat of 35 percent by weight was then applied over the make coat and minerals, and the coating was cured for 16 hours at 212 degrees Fahrenheit (100 degrees Celsius). A 30 percent by weight aqueous dispersion of 85:15 by weight zinc stearate polyacrylate was applied over the size coat.

Attachment Backing 1 (AB 1)

The hook component of a releasable mechanical fastener system was made according to the method described in U.S. Pat. No. 6,843,944 (Bay et al.). The resultant polypropylene attachment backing had a 5 mils (127 micrometers) thickness, stem diameter 14 mils 355.6 micrometers), cap diameter 30 mils (0.76 millimeters), stem height 20 mils (508 micrometers) and a frequency of 340 stems per square inch (52.7 stems per square centimeter). The backing had zero open space.

Attachment Backing 2 (AB2)

A polypropylene mesh hook backing material was made according to the methods reported by U.S. Publication 2004/0170802 (Seth et al.), the disclosure of which is incorporated herein by reference. The die geometry was similar to the die used to make the polymer netting shown in FIG. 10 of U.S. Publication 2004/0170802 (Seth et al.). However, in contrast to the article shown in FIG. 10 of U.S. Publication 2004/0170802 (Seth et al.), the hooks on the first plurality of strands were not cut and therefore, were reduced to approximately one-third there molded size after longitudinally stretching of the first strands at a stretch ratio of about 3. The uncut hooks of the first plurality of strands formed the surface for attaching the polymer netting to the screen abrasive. The second plurality of strands had a final thickness of approximately 9 mils (228.6 micrometers), and comprised a plurality of hooks having a stem height of 29 mils (736.6 micrometers), stem diameter 10 mils (254 micrometers) and stem frequency of approximately 450 stem per square inch (70 stems per square centimeter). The open space of the polymer netting accounted for 80 percent of the total surface area of the area formed by the perimeter of the polymer netting.

Comparative

An adhesive, type "3M 77 SPRAY ADHESIVE" from 3M Company, was lightly sprayed onto the non-abrasive side of the screen abrasive and to one side of AB 1, and the two materials laminated together. 12.7 centimeter discs were then die cut from the laminate sheet.

Example

The non-abrasive side of screen abrasive was laminated to one side of AB2 according to the method described in Comparative A. Likewise, 12.7 centimeter sample discs were then die cut from the laminate.

Both the Comparative and the Example were subjected to Sanding Tests 1 and 2. Results are listed in Table 1 and Table 2, respectively.

TABLE 1

| | Sanding Test 1 | |
|---|---|---|
| Sample | Average Total Cut (grams) | Swarf Present on Scrim |
| Comparative | 4.8 | Yes |
| Example | 6.2 | No |

TABLE 2

| | Sanding Test 2 | |
|---|---|---|
| Sample | Average Total Cut (grams ) | Swarf Present on Scrim |
| Comparative | 3.8 | Yes |
| Example | 6.3 | No |

It is to be understood that even in the numerous characteristics and advantages of the present invention set forth in above description and examples, together with details of the structure and function of the invention, the disclosure is illustrative only. Changes can be made to detail, especially in matters of the dimensions and compositions of the screen abrasive and polymer netting within the principles of the invention to the full extent indicated by the meaning of the terms in which the appended claims are expressed and the equivalents of those structures and methods.

What is claimed is:

1. An abrasive article comprising:

a screen abrasive comprising an open mesh backing having a first major surface having a perimeter that defines a screen abrasive surface area, a second major surface, a plurality of openings extending from said first major surface to said second major surface, and an abrasive layer secured to at least a portion of said first major surface of said backing, said abrasive layer comprising a plurality of abrasive particles and at least one binder; and a polymer netting adhered to said second major surface of said open mesh backing, said polymer netting comprising a first plurality of strands extending in a first direction, a second plurality of strands extending in a second direction, said first and second plurality of strands affixed to one another to form a plurality of openings in said polymer netting, and a plurality of hooks projecting from at least a portion of said second plurality of strands, wherein said openings of said polymer netting cooperate with said openings of said screen abrasive to allow the flow of particles through said abrasive article.

2. The abrasive article of claim 1 wherein said open mesh backing is woven.

3. The abrasive article of claim 2 wherein said open mesh backing comprises at least one of fiberglass, nylon, polyester, polypropylene, or aluminum.

4. The abrasive article of claim 1 wherein said open mesh backing is a perforated film.

5. The abrasive article of claim 1 wherein said openings in said open mesh backing have an average open area of at least 0.3 square millimeters.

6. The abrasive article of claim 1 wherein said openings in said open mesh backing have a total open area of at least 50 percent of said screen abrasive surface area.

7. The abrasive article of claim 1 wherein said particles that flow through said abrasive article comprise particles having a size of at least 10 micrometers.

8. The abrasive article of claim 1 wherein said openings of said net are rectilinear.

9. The abrasive article of claim 1 wherein said first and second directions are substantially perpendicular to one another.

10. The abrasive article of claim 1 wherein said first and second strands are integral.

11. The abrasive article of claim 1 wherein said openings of said polymer netting form a cumulative open area that is in the range of 70 to 90 percent of said screen abrasive surface area.

12. The abrasive article of claim 1 wherein said polymer netting comprises a thermoplastic.

13. The abrasive article of claim 1 wherein said polymer netting comprises a polymeric material selected from at least one of polyethylene or polypropylene.

14. The abrasive article of claim 1 further comprising adhesive securing said polymer netting to said second major surface of said open mesh backing.

15. The abrasive article of claim 1 wherein said abrasive particles are erectly oriented.

16. A method of making an abrasive article comprising:

providing a screen abrasive comprising an open mesh backing having a first major surface having a perimeter that defines a screen abrasive surface area, a second major surface, a plurality of openings extending from said first major surface to said second major surface, and an abrasive layer affixed to at least a portion of said first major surface of said backing, said abrasive layer comprising a plurality of abrasive particles and at least one binder;

providing a polymer netting adhered to said second major surface of said open mesh backing, said polymer netting comprising a first plurality of strands extending in a first direction, a second plurality of strands extending in a second direction, said first and second plurality of strands affixed to one another to form a plurality of openings in said polymer netting, and a plurality of hooks projecting from at least a portion of said second plurality of strands, and affixing said polymer netting to at least a portion of said second major surface of said open mesh backing, wherein said openings of said polymer netting cooperate with said openings of said screen abrasive to allow the flow of particles through said abrasive article.

17. The method of claim 16 further comprising applying an adhesive onto at least one of said second major surface of said open mesh backing and said polymer netting.

18. The method of claim 16 wherein said openings of said polymer netting form a cumulative open area that is in the range of 70 to 90 percent of said screen abrasive surface area.

19. The method of claim 16 further comprising engaging said plurality of hooks to an orbital sander having a backup pad surface comprising a loop material.

* * * * *